United States Patent [19]

Pärsson

[11] 3,971,241

[45] July 27, 1976

[54] OPERATING DEVICE FOR LOCKING MECHANISMS IN DOORS, HATCHES AND THE LIKE

[75] Inventor: Nils Owe Pärsson, Trollhattan, Sweden

[73] Assignee: Saab-Scania Aktiebolag, Sodertalje, Sweden

[22] Filed: Sept. 23, 1974

[21] Appl. No.: 508,716

[30] Foreign Application Priority Data

Sept. 24, 1973 Sweden ..... 7312946

[52] U.S. Cl. ..... 70/275; 70/144; 292/144; 292/201

[51] Int. Cl.[2] ..... E05B 51/02

[58] Field of Search ..... 292/144, 201; 70/275, 70/144, 263

[56] References Cited

UNITED STATES PATENTS

| | | | |
|---|---|---|---|
| 392,451 | 11/1888 | Ostrander | 292/201 |
| 518,119 | 4/1894 | Schnepf | 292/201 X |
| 1,555,174 | 9/1925 | Williams | 292/201 |
| 2,234,426 | 3/1941 | Cooley | 292/144 X |
| 2,237,192 | 4/1941 | Minkow et al. | 292/144 X |
| 2,298,776 | 10/1942 | Rhein | 292/144 |
| 2,688,865 | 9/1954 | Foster et al. | 292/144 X |
| 2,763,888 | 9/1956 | Billeter | 292/144 X |
| 2,927,811 | 3/1960 | Rea et al. | 292/144 X |
| 3,199,153 | 8/1965 | Weinstein | 292/201 X |
| 3,698,136 | 10/1972 | Grosseau | 292/201 X |

FOREIGN PATENTS OR APPLICATIONS

| | | | |
|---|---|---|---|
| 366,946 | 1/1923 | Germany | 292/144 |
| 1,930,696 | 12/1970 | Germany | 292/144 |
| 979,343 | 1/1965 | United Kingdom | 292/201 |
| 15,188 | 1/1910 | United Kingdom | 292/144 |

*Primary Examiner*—Roy D. Frazier
*Assistant Examiner*—Rodney H. Bonck
*Attorney, Agent, or Firm*—Cushman, Darby & Cushman

[57] ABSTRACT

An operating device for locking mechanisms in doors or the like, especially on vehicles. A sealed system of flexible bellows interconnected by pipes is used to transfer a manual compression of an actuating bellows into an expansion of a bellows which is actuating the bolt of a locking mechanism.

6 Claims, 2 Drawing Figures

FIG.1
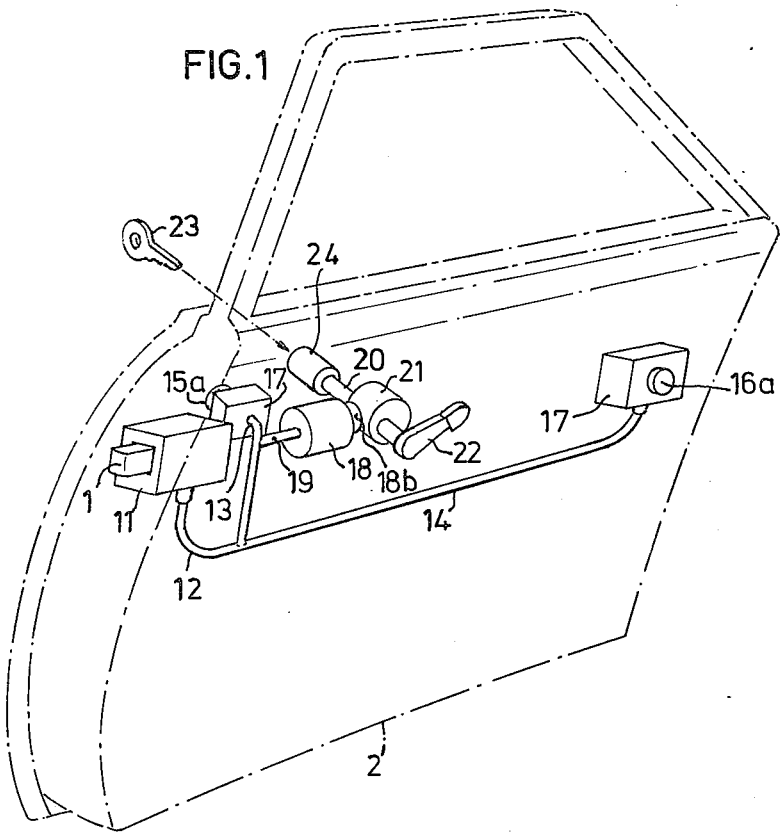
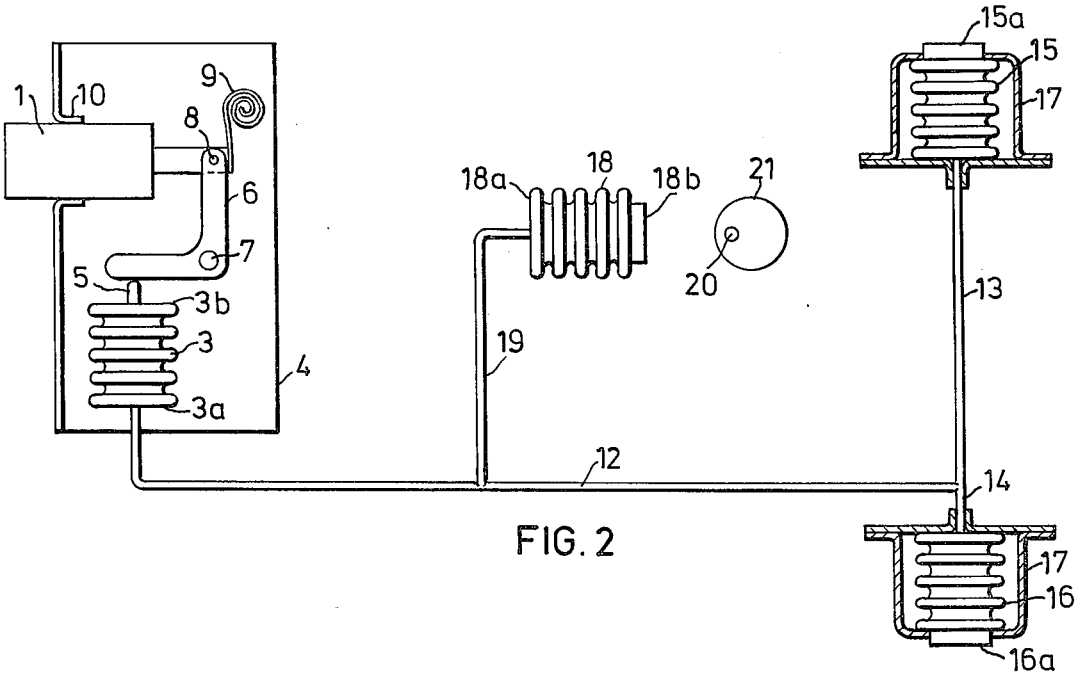
FIG. 2

OPERATING DEVICE FOR LOCKING MECHANISMS IN DOORS, HATCHES AND THE LIKE

The present invention relates to an operating device for locking mechanisms in doors, hatches or the like, comprising an actuating means for the bolt or corresponding element of the locking mechanism, at least two manually operable releasing means and pipes which connect the actuating means with the releasing means to form a closed system which is filled with a liquid for transferring a volume change in one of the releasing means into a corresponding volume change in the actuating means.

The invention is especially intended for use in doors and hatches for vehicles, but it can also be used with advantage for locking mechanisms in other connections. In the following description the application of the invention to vehicles will chiefly be described.

For operating locking mechanisms in doors, hatches and the like, it is conventional to use mechanical devices for transmitting a movement from a manually actuated means to the locking mechanism. In many cases, however, these devices are not completely satisfactory. If the manually operable means is placed in the immediate vicinity of the locking mechanism the device will indeed be relatively simple, but in most cases it is not practically feasible to use such a placing. The manually operable means is then placed at a distance from the locking mechanism, and the movements are transmitted by levers, links, cables or the like elements. Such a device will be complicated and expensive, not only since it comprises a great number of details but also since it requires great accuracy both on manufacture of the separate details and on assembly of these in order that the result shall be the one desired. Furthermore, such a device gives rise to relatively large friction, and the forces required for operating the locking mechanism will therefore be relatively large.

The object of the present invention is to eliminate the disadvantages described above, and to provide an operating device of the kind mentioned in the introduction, which is simple and cheap in production and assembly and gives greater freedom of choice in placing the details incorporated in the device. This is accomplished by giving the operating device the distinguishing features which are apparent in the following claims.

The invention will now be more closely described while referring to the attached drawing, on which FIG. 1 is a schematic perspective view of a device according to the invention built into a vehicle door, and FIG. 2 is a schematic plan view of the device according to FIG. 1.

The embodiment of the device according to the invention shown on the drawing is made as an operating device for a locking mechanism in the form of an axially movable locking bolt 1, mounted in the door 2 of a motor vehicle.

The device according to the invention includes an operating element in the shape of a flexible metal bellows 3. One end 3*a* of the bellows 3 is attached to a support plate 4 while the other end 3*b* of the bellows is free and via a pin 5 attached to it, engages one arm of a bell crank 6, which is pivotally mounted on a pin 7 attached to the support plate 4. The other arm of the bell crank 6 is swivellingly joined by a pin 8 with the rear portion of the locking bolt 1. The latter is displaceably mounted in a guide 10 in the support plate 4, and is together with the details 3–9 suitably built into a housing 11, as may be seen from FIG. 1. In the housing 11 a spring attached to the carrying plate 4, presses the locking bolt 1 into a position projecting away from the housing 11.

The bellows 3 is completely sealed, with the exception of its being provided at its end 3*a* with a union for a pipe 12, from which a number of branch pipes depart. Each of two branch pipes 13 and 14 are connected to a releasing element in the form of a flexible metal bellows 15 and 16 respectively. The bellows 3, 15 and 16 and the pipes 12, 13 and 14 are filled with an operating medium in the form of a gas or liquid which can transmit movement from one bellows to another. Each of the bellows 15 and 16 are intended, on volume change, to initiate a movement in the bellows 3, which thereby actuates the locking bolt 1 via the bell crank 6. Manual compression of one of the bellows 15 or 16 causes an expansion of the bellows 3, causing the locking bolt 1 to be withdrawn into the housing 11 against the bias of the spring 9. So that compression of the bellows 15 will not lead to an expansion of the bellows 16 or vice versa without actuation of the bellows 3, each of the bellows 15 and 16 is mounted in a cover 17. The cover 17 limits the maximum volume of each of the bellows 15 and 16 respectively and is made with an opening through which projects a narrower end portion 15*a* and 16*a* of the bellows 15 and 16 respectively. The end portions 15*a* and 16*a* can thus be actuated manually to initiate the desired movements. The covers 17 are built into the door 2 so that only the end portions 15*a* and 16*a* project from the outside and inside respectively of the door 2.

To enable locking the door, i.e. to make the bellows 3 inoperable, an expansion element in the shape of a flexible metal bellows 18 is connected by a pipe 19 to the piping circuit 12,13,14. This connection has great adaptability in relation to the available space, and on the drawing two conceivable connecting possibilities are shown. According to FIG. 1 the pipe 19 is connected to the pipe 13 and according to FIG. 2 the pipe 19 is connected to the pipe 12. The end 18*a* of the bellows 18 which is fixedly attached to the pipe 19, is attached to the door 2, while the other closed end 18*b* is free. The volume of the bellows 18 is so selected that when the bellows 18 is allowed to expand freely the bellows 3 is not affected by compression of the bellows 15 or 16. The operating medium pressed out of bellows 15 or 16 causes an expansion of the bellows 18 instead. Adjacent to the free end 18*b* of bellows 18 there is a shaft 20 rotatably mounted in the door 2. The shaft 20 carries an eccentric 21 attached to it, which has an axial position opposite the bellows 18. In the position shown in FIG. 2 the bellows 18 can expand independent of the eccentric 11, but when the shaft 20 is turned 180° the eccentric 21 will prevent or at least limit the expansion of the bellows 18. This means that movements of the bellows 15 or 16 are transferred to the bellows 3, so that the locking bolt 1 can be operated as has been previously described.

The shaft 20 with the eccentric 21 is operated from the inside of the door 2 by a lever 22 and from the outside of the door by a key 23. The latter fits in a lock cylinder 24, which is made in a conventional manner and is non-rotatably attached to the shaft 20. A lock housing (not shown) containing the lock cylinder 24 is mounted in the door 2 in a manner known per se.

The invention is not limited to the embodiments described above, but alterations can be made within the scope of the following claims. For example, locking of the door can take place by having a mechanical latching means brought into cooperation with the locking bolt 1 for latching this in a locked position.

What I claim is:

1. An operating device for a lock-bolt or the like for doors, hatches or the like comprising an actuating means for the lock-bolt, at least two manually operable releasing means and pipes which connect the actuating means with the releasing means to form a closed system filled with a liquid for transferring a volume change in one of the releasing means into a corresponding volume change in the actuating means for the lockbolt, said system including an expansion means coacting with a manually operable latching means which in at least one position limits expansion of the expansion means by contact therewith, each of the actuating, releasing and expansion means including a flexible bellows, one end of a bellows being closed and the other end of a bellows being in communication with the closed system.

2. An operating device as in claim 1 wherein each releasing means is provided with a means which limits the maximum volume of said releasing means.

3. An operating device as in claim 1 wherein the latching means is operated by a locking key.

4. An operating device as in claim 1 wherein the latching means is operated by a lever.

5. A locking mechanism for doors, hatches or the like comprising a lock member moveable between a lock position and a release position; actuating means including a fluid-filled, flexible actuating bellows for urging said lock member to its release position upon expansion of said actuating bellows; at least two manually compressible fluid-filled release bellows in fluid connection with said actuating bellows; a fluid-filled expansion bellows in fluid connection with the actuating bellows and with the release bellows; and manually operable latching means having a first position wherein expansion of said expansion bellows is limited by contact of said latching means with said expansion bellows, and a second position permitting expansion thereof, whereby when said latching means is in its first position manual compression of a release bellows effects expansion of said actuating bellows, and whereby when said latching means is in its second position manual compression of a release bellows effects expansion of said expansion bellows.

6. A locking mechanism as in claim 5 including means limiting the maximum expansion of each of said release bellows.

* * * * *